US008847131B2

(12) United States Patent
Fang

(10) Patent No.: US 8,847,131 B2
(45) Date of Patent: Sep. 30, 2014

(54) MICROWAVE OVEN WITH ROTARY COOKING APPARATUS

(76) Inventor: Lee Fang, Amherst, NY (US)

( * ) Notice: Subject to any disclaimer, the term of this patent is extended or adjusted under 35 U.S.C. 154(b) by 1190 days.

(21) Appl. No.: 12/157,689

(22) Filed: Jun. 12, 2008

(65) Prior Publication Data

US 2009/0218337 A1 Sep. 3, 2009

Related U.S. Application Data

(60) Provisional application No. 61/067,903, filed on Mar. 3, 2008.

(51) Int. Cl.
*H05B 6/80* (2006.01)
*H05B 6/00* (2006.01)
*H05B 6/64* (2006.01)

(52) U.S. Cl.
CPC ..... *H05B 6/6402* (2013.01); *H05B 6/6411* (2013.01)
USPC ..... 219/726; 219/735; 219/756

(58) Field of Classification Search
CPC ..... H05B 6/6411; H05B 6/6402
USPC ..... 219/725–735, 518, 716, 756; 99/451
See application file for complete search history.

(56) References Cited

U.S. PATENT DOCUMENTS

| | | | | |
|---|---|---|---|---|
| 2,870,020 | A * | 1/1959 | Ashley | 426/311 |
| 3,276,138 | A | 10/1966 | Fritz | |
| 3,427,422 | A | 2/1969 | Muller | |
| 3,462,575 | A | 8/1969 | Holaday | |
| 3,502,848 | A | 3/1970 | Fink | |
| 3,777,095 | A | 12/1973 | Muranaka | |
| 4,048,473 | A | 9/1977 | Burkhart | |
| 4,120,981 | A * | 10/1978 | Burkhart | 426/231 |
| 4,286,133 | A | 8/1981 | Einset et al. | |
| 4,471,195 | A * | 9/1984 | Ishii et al. | 219/752 |
| 4,571,474 | A | 2/1986 | Pomroy | |
| 4,714,813 | A | 12/1987 | Trenchard | |
| RE34,373 | E | 9/1993 | Collins et al. | |
| 5,245,149 | A | 9/1993 | Pinna et al. | |
| 6,177,663 | B1 | 1/2001 | Kula | |
| 6,307,193 | B1 * | 10/2001 | Toole | 219/735 |
| 6,998,593 | B2 | 2/2006 | Lee | |

FOREIGN PATENT DOCUMENTS

| | | |
|---|---|---|
| CN | 2591464 | 12/2003 |
| CN | 2761104 | 3/2006 |
| JP | 04263704 | 9/1992 |
| JP | 07298982 | 11/1995 |

* cited by examiner

*Primary Examiner* — Jianying Atkisson
(74) *Attorney, Agent, or Firm* — Simpson & Simpson, PLLC

(57) ABSTRACT

A rotary cooking apparatus for a microwave oven including a hollow drum for holding food, said drum including a first open end and a second closed end, a lid detachably securable onto said first end of said drum, wherein said lid includes a support shaft protruding from said lid operatively arranged to engage in a freely rotatable manner with a support means, and wherein said lid includes a ventilation hole, a ventilation insert secured between said cooking drum and said lid when said lid is secured onto said drum, wherein said ventilation insert includes a ventilation means, and a socket in said second end of said drum, wherein said socket has a shape corresponding to a cross-section of a head on a driving shaft of a motor, wherein said head of said driving shaft complimentarily engages in said socket for rotating said drum via said motor.

16 Claims, 4 Drawing Sheets

MICROWAVE OVEN WITH ROTARY COOKING APPARATUS

CROSS REFERENCE TO RELATED APPLICATIONS

This patent application claims the benefit under 35 U.S.C. §119(e) of U.S. Provisional Application No. 61/067,903, filed Mar. 3, 2008, which application is incorporated herein by reference.

FIELD OF THE INVENTION

The present invention generally relates to microwave ovens, more specifically to a rotary cooking apparatus for mixing food during a microwave cooking operation.

BACKGROUND OF THE INVENTION

Microwave ovens have long been known in the art. Typical microwaves currently come equipped with a turntable located at the bottom of the microwave which rotates about a vertical axis. The turntable moves the food about the microwave to facilitate a more thorough and uniform heating. However, it is well known that despite the improved cooking provided by the turntable, food at the top surface and around the edges will become significantly hotter than the central and bottom portions of the food. For example, if a bowl of soup is heated in a microwave, the top surface of the soup may be very hot, and begin to burn around the edges, but the soup located at the bottom of the bowl may remain quite cool, because the microwaves can not penetrate as efficiently deep into the bowl. Thus, a user must take the bowl out and manually stir the soup to obtain the desired uniform temperature. Of course, essentially all foods, not just soups, are heated in a similar non-uniform fashion, with burning or overheating occurring at the top surface of the food and around the edges.

In an attempt to solve the above problem, some microwave ovens have been designed which rotate about a substantially horizontal axis for mixing food during cooking. Thus, the food located at the top surface is constantly changing and mixing, so that the food is more thoroughly heated than with a turntable alone. However, these microwave ovens no longer rotate about a vertical axis, or they require modifications to a microwave oven which would make conventional use of the microwave impossible.

Also, these devices are not easily detachable from a motor's driving shaft, and therefore, they are not easily removable from the microwave oven. For example, the apparatus disclosed in U.S. Pat. No. 4,471,195 (Ishii et al.) includes driving and support shafts which are secured through the top and bottom of a rotary receptacle to the inside of the receptacle. Furthermore, the driving and support shafts are affixed in the walls of the microwave which houses the rotary receptacle. Thus, the receptacle in this reference can not be used effectively for storage of food either before or after cooking. Additionally, the device can not be easily loaded with food, removed for cleaning, or replaced.

Furthermore, the prior art does not teach a rotational cooking device for use in a microwave oven which includes a sufficient ventilation means for ensuring that steam does not gather inside the drum or container of the cooking device. Furthermore, closed containers which experience an increase in temperature also undergo a proportional increase in pressure. This increase in pressure could damage the container, or in a worst case scenario, cause the container to burst. The steam and pressure caused by microwave cooking can be extremely dangerous and cause injury if a container containing steam and which is under pressure is opened proximate to a person or if the container bursts near a person. For example, numerous cases of eye and other facial injuries have been reportedly caused by steam released from popcorn bags that were opened shortly after microwaving. Thus, what is also needed is a proper ventilation means so that steam and pressure do not dangerously gather in the cooking drum.

Thus, what is needed is a cooking apparatus for microwave ovens which is easily separable from the microwave oven, mixes food both horizontally and vertically, and includes a sufficient ventilation means for preventing injury to users of the apparatus.

BRIEF SUMMARY OF THE INVENTION

The present invention broadly comprises a rotary cooking apparatus including a generally hollow drum for holding food, the drum including a first end and a second end, wherein the first end is open and the second end is closed, a lid detachably securable onto the first end of the drum for sealing the drum, wherein the lid includes a support shaft protruding from the lid operatively arranged to engage in a freely rotatable manner with a support means, and wherein the lid includes a ventilation hole for enabling steam and pressure to escape the drum during cooking, a ventilation insert secured between the cooking drum and the lid when the lid is secured onto the drum, wherein the ventilation insert includes a ventilation means for enabling an escape of steam and pressure from the drum during operation of the oven, and a socket in the second end of the drum, wherein the socket has a shape corresponding to a cross-section of a head on a driving shaft of a motor, wherein the head of the driving shaft is operatively arranged to complimentarily engage in the socket for rotating the drum via the motor.

In one embodiment, the lid and the first end of the drum are complimentarily threaded for detachably securing the lid on the drum. In another embodiment, the drum includes a mixing means for thoroughly mixing the food during operation of the apparatus. In a further embodiment, the mixing means comprises at least one blade arranged about an interior of the drum. In yet a further embodiment, the blade is corkscrewed about the interior of the drum. In yet a further embodiment, the blade is operatively arranged with respect to an output direction of rotation of the motor to move food in the drum proximate to the second end of the drum towards the first end of the drum.

In one embodiment, the drum has a cross-sectional shape resembling a hollow polygon. In another embodiment, the ventilation means in the ventilation insert is substantially axially misaligned with respect to the ventilation hole in the lid for enabling an escape of steam, but not food, from the drum during cooking. In another embodiment, the driving shaft and the support shaft are concentrically aligned with respect to an axis. In a further embodiment, the drum is also generally aligned with respect to the axis.

The current invention also comprises a microwave oven including a cooking chamber having a first wall and a second wall, wherein the first and second walls are substantially opposite from each other, a motor housed in the microwave oven outside of the cooking chamber, wherein the motor includes a driving shaft that extends through the first wall of the cooking chamber into the cooking chamber, a support means proximate to the second wall of the cooking chamber, and a rotary cooking apparatus housed within the cooking chamber of the microwave oven including a generally hollow drum for holding food, the drum including a first end and a second end, wherein the first end is open and the second end is closed, a lid detachably securable onto the first end of the drum for sealing the drum, wherein the lid includes a support shaft protruding from the lid operatively arranged to engage in a freely rotatable manner with the support means, wherein the lid includes a ventilation hole for enabling steam and pressure to escape the drum during cooking, a socket in the second end of the drum, wherein the socket has a shape corresponding to a cross-section of a head on the driving shaft of the motor, wherein the head of the driving shaft is operatively arranged to complimentarily engage in the socket for rotating the drum via the motor, and wherein the support shaft and the driving shaft are concentrically aligned with an axis, and the axis is arranged obliquely between the first wall and second wall of the cooking chamber.

In one embodiment, the cooking apparatus housed in the microwave oven further includes a ventilation insert secured between the cooking drum and the lid when the lid is secured onto the drum, wherein the ventilation insert includes a ventilation means for enabling an escape of steam and pressure from the drum during operation of the oven. In another embodiment, the support means is a support bracket mounted on the second wall, and the support bracket includes a notch for engaging with the support shaft.

It is a general object of the present invention to provide a cooking apparatus for use in a microwave to thoroughly mix food during cooking. It is another object of the present invention to provide a cooking apparatus with the above objective that also includes a ventilation means for releasing steam and pressure that may be created during cooking. It is yet a further object of the present invention to provide a cooking apparatus with the above objectives that can quickly and easily be removed from or installed in a microwave oven.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it should be understood that this invention is not limited to the particular methodology, materials and modifications described and as such may, of course, vary. It should also be understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1A:
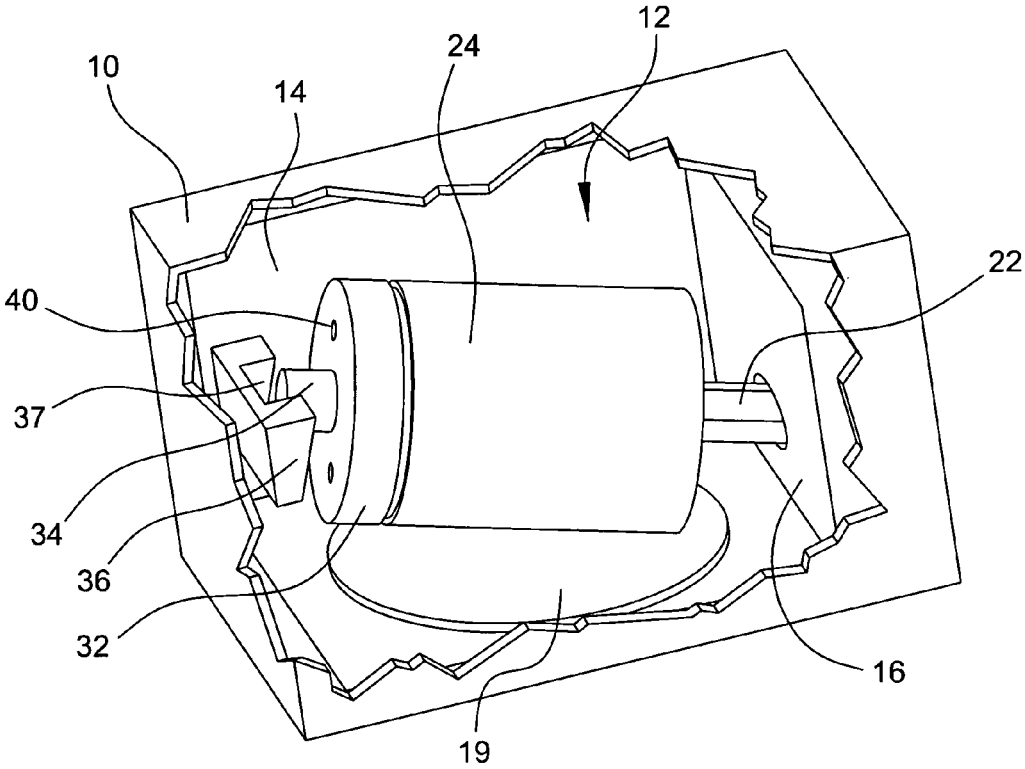
FIG. 1A is a perspective view of the current invention cooking apparatus installed in a microwave oven.
Figure 1B:
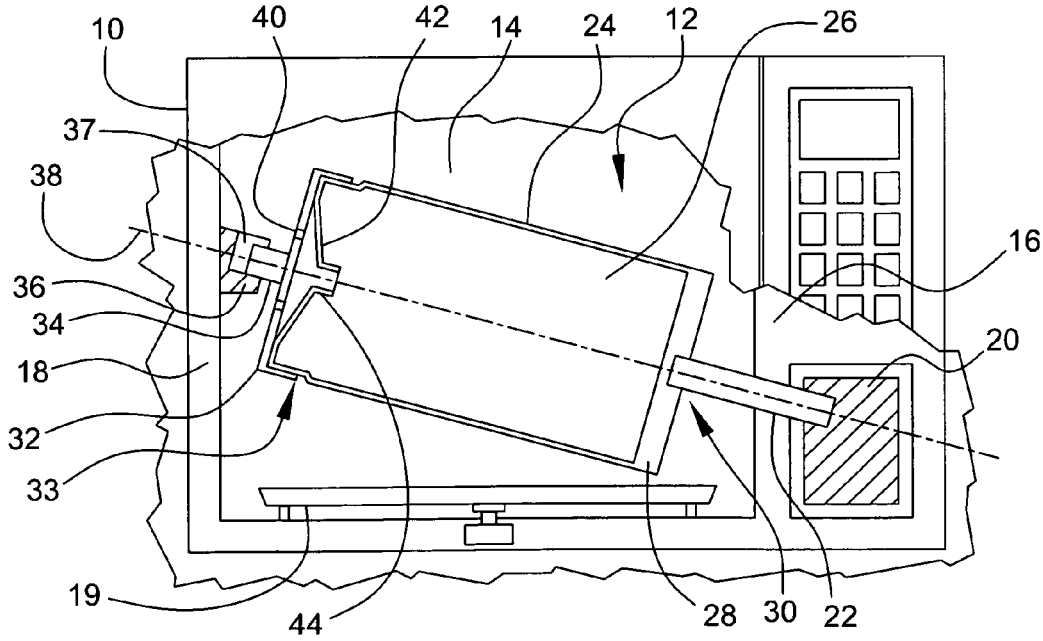
FIG. 1B is a cross-sectional view showing the current invention cooking apparatus and microwave oven of FIG. 1.

Referring now to the Figures, FIGS. 1A and 1B show microwave oven 10, with cutaways illustrating current invention cooking apparatus 12 located within cooking chamber 14 of the microwave oven. Although the cooking apparatus is generally shown cross-sectionally in FIG. 1B, some hatchlines have been removed for clarity. It should be appreciated that oven 10 is not shown in detail, as the oven is substantially similar in structure and function to known conventional microwave ovens, except with regard to any changes that will be discussed below, particularly with respect to the current invention. In other words, the microwave oven may include a clock, allow a user to change the power level of the microwave, and include timer, defrost and other functions, to name just a few features of prior art microwave ovens.

Cooking apparatus 12 can be seen mounted generally between walls 16 and 18 of the cooking chamber, with walls 16 and 18 located opposite from each other. The cooking chamber is preferably similar to conventional microwave oven cooking chambers, comprising a partial Faraday's cage arranged to receive microwaves which interact with water, fat, and other molecules for cooking food. The cooking chamber may also include turntable 19, as is typical for conventional microwave ovens. The cooking apparatus is preferably arranged so that it does not interfere with the turntable, and therefore, the turntable does not need to be removed from the microwave to use the current invention. Thus, the microwave oven can be used conventionally if the current invention cooking apparatus is temporarily not required.

In the shown embodiment, motor 20 is located within microwave 10, but on the opposite side of wall 16 from the cooking chamber. Driving shaft 22 extends through wall 16 into cooking chamber 14 to connect with cooking apparatus 12. Wall 16 may include a bearing or some other means to facilitate a rotation of driving shaft 22 due to motor 20. The cooking apparatus generally includes drum 24, which defines cavity 26 for holding food. Drum 24 includes closed end, or bottom 28, which has socket 30 for engaging with driving shaft 22, so that the driving shaft can rotate the drum. The drum is shown housed at an angle obliquely between walls 16 and 18. That is, drum 24 is not perpendicular to walls 16 or 18.

The end opposite from closed end 28 is open, and can be selectively closed by means of lid 32. In a preferred embodiment, lid 32 detachably secures onto drum 24 by a detachable securing means, namely, threads 33, which are complimentarily arranged in the lid and drum. Support shaft 34 can be seen protruding from lid 32. The support shaft engages with support bracket 36 on wall 18. Shaft 34 is cylindrical and bracket 36 has a correspondingly rounded U-shaped notch 37 for enabling shaft 34 to freely rotate within the bracket, while still supporting the shaft from the bottom and both sides. It should be appreciated that bracket 36 may be excluded if a notch similar to notch 37 is put directly into wall 18. Thus, either bracket 36, as shown, or a notch in wall 18 could function sufficiently as a support means for support shaft 34.

Support shaft 34 is concentric with socket 30, and therefore also with driving shaft 22. In other words, cooking apparatus 12, including drum 24 and shafts 22 and 34, rotate generally about axis 38. The axis, as shown, is at an angle obliquely between walls 16 and 18. That is, the axis is not arranged parallel or perpendicular to the walls. Alternatively stated, the axis could be arranged at other angles between perfectly horizontal and vertical, or between parallel and perpendicular to walls 16 and 18.

To provide proper ventilation, lid 32 includes ventilation holes 40. The ventilation holes allow steam and pressure that is produced during cooking to be released from drum 24. In the shown embodiment, there are only two ventilation holes 40, but it should be appreciated that other embodiments may include more or less holes arranged about lid 32 as needed. In a preferred embodiment, ventilation insert 42 is included between lid 32 and drum 24. The ventilation insert includes ventilation tube 44, to act as a ventilation means for allowing the escape of steam from the drum. In another embodiment, the ventilation insert could include just a hole, instead of having a ventilation tube, which would also function as a ventilation means. However, the structure of the ventilation tube reduces the likelihood that food can splatter, spill, or otherwise escape from the drum, as the food would have to travel up and out of the tube. It can further be seen that ventilation tube 44 is aligned along axis 38, while ventilation holes 40 in lid 32 are not. This misalignment between the ventilation tube and ventilation holes also reduces the chance of food exiting the drum, because most food that manages to make it through ventilation tube 44 should be caught between the ventilation insert and the lid. Alternatively, it should be understood that ventilation insert 42 could include holes misaligned with respect to axis 38, while support shaft 34 could have a longitudinal bore therethrough. Thus, the holes, or bores, in the ventilation insert and lid would still be misaligned with respect to each other for enabling the escape of steam and pressure, but not food, from the cooking apparatus.

Figure 2:
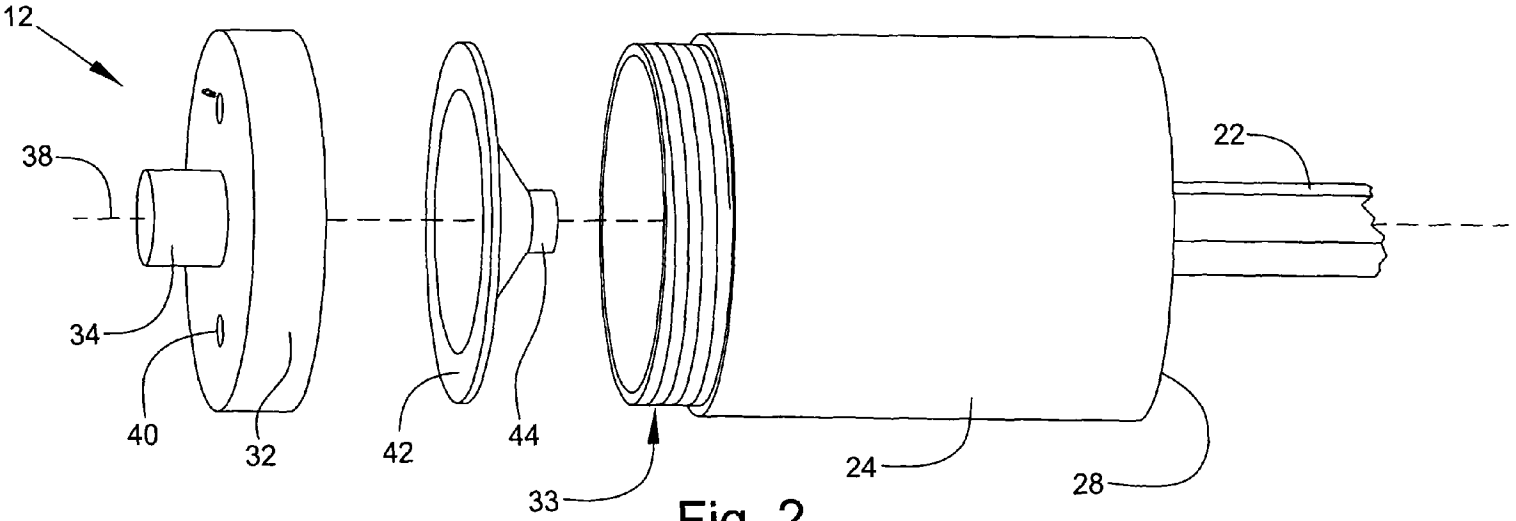
FIG. 2 is a perspective exploded view of the cooking apparatus of FIG. 1.

FIG. 2 shows an exploded view of cooking apparatus 12. Once again, it can be seen that shaft 22 engages into bottom 28 of drum 24. Also, ventilation insert 42 fits between the drum and lid 32, when the lid is secured onto the drum by threaded connection means 33. Lid 32 is also shown having ventilation holes 40 and support shaft 34. Additionally, it can be seen that support shaft 34, ventilation insert 42, drum 24, and driving shaft 22 are all generally aligned along axis 38.

Figure 3:
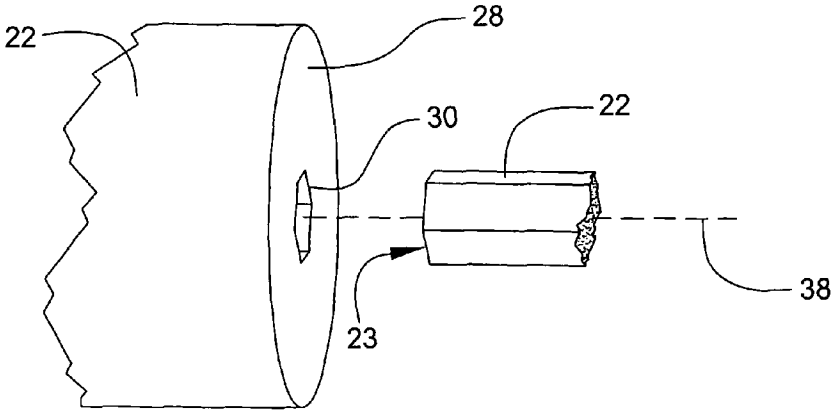
FIG. 3 is a perspective view illustrating a socket in a drum of the cooking apparatus shown in FIG. 1, and a complimentarily shaped driving shaft.

FIG. 3 shows bottom 28 of drum 24 which includes socket 30. In the shown embodiment, socket 30 is a hexagonally shaped depression in bottom 28 of drum 24. Likewise, shaft 22 has a hexagonal cross-section. Thus, shaft 22 can engage within socket 30 for enabling motor 20 to rotate the cooking apparatus. In a preferred embodiment, socket 30 is marginally larger than shaft 22, so that the drum can slide easily onto the shaft, but also so that the shaft and the drum engage firmly together. That is, the socket and driving shaft may be fabricated with suitable tolerances to create a sliding fit between the socket and driving shaft. For this reason, in preferred embodiments, shaft 22 can not have a circular cross-section, because the socket and shaft would not be able to rotatably engage together unless there was a tight force fit between the shaft and the socket. A tight force fit is not preferred because then it would be difficult to remove the drum from microwave oven. It should be understood that only end, or head, 23 of the driving shaft that engages with the socket needs to be non-circular, as the rest of the shaft does not engage with the socket. As mentioned previously, the shaft needs to pass through and be freely rotatable with respect to wall 16 of cooking chamber 14. Therefore, it may be advantageous to fabricate shaft 22 from a cylindrical bar, and remove material from the shaft to shape head, or end 23 of the shaft into a cross-sectional shape relating to the shape of socket 30. Thus, the shaft could easily engage with a bearing (not shown) in wall 16, as well as engage non-circularly in socket 30.

Figure 4A:
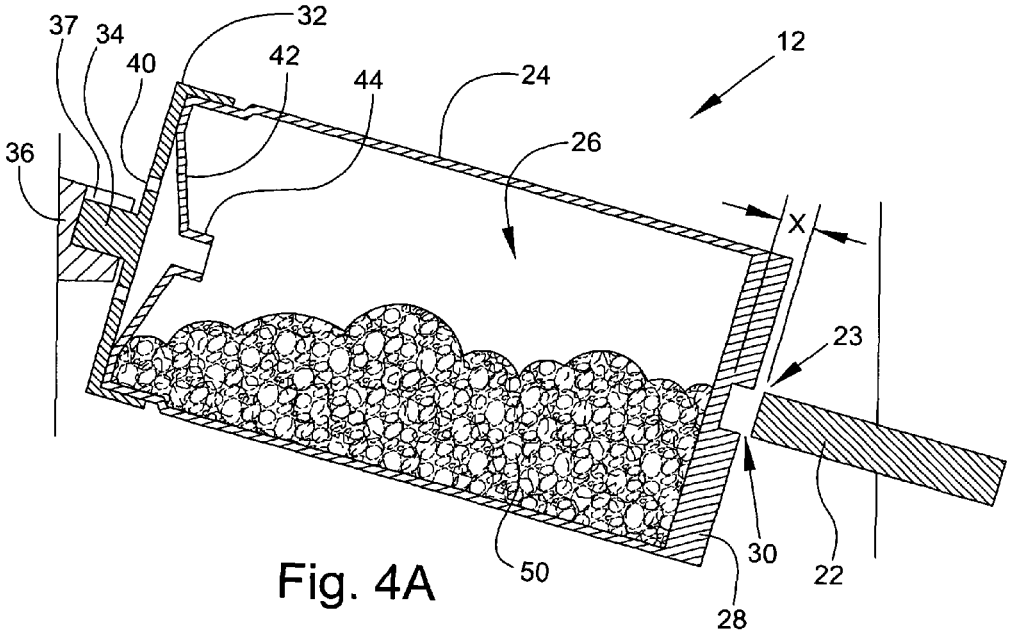
FIGS. 4A and 4B are cross-sectional views of the cooking apparatus shown in FIG. 1 illustrating how the apparatus is installed in or removed from a microwave oven.
Figure 4B:
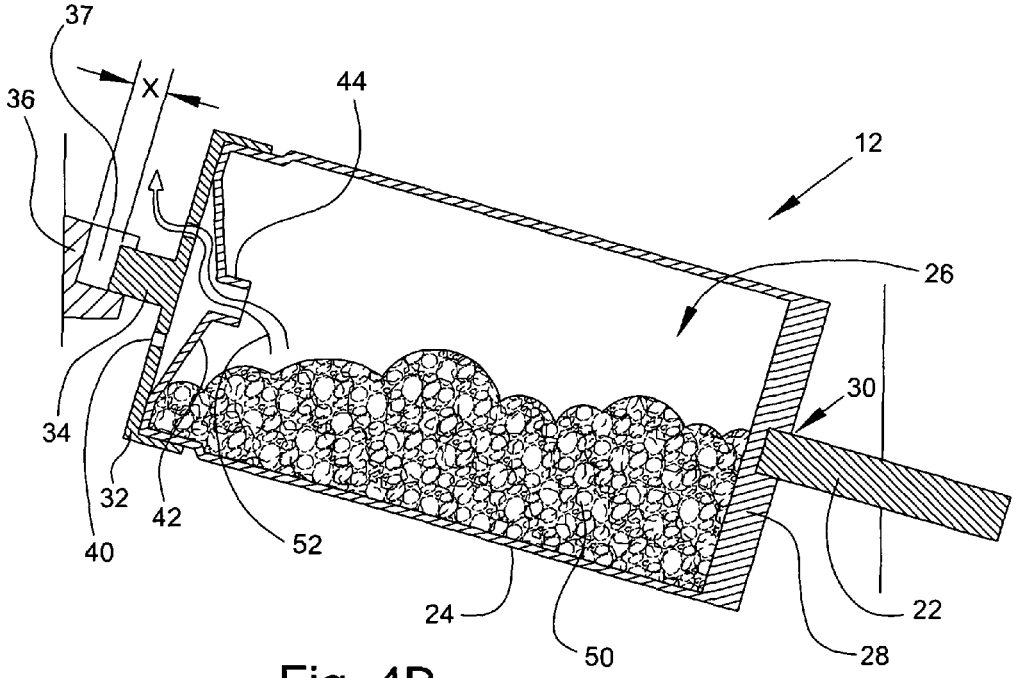

Food 50 is shown located inside cavity 26 of drum 24 in FIGS. 4A and 4B. It should, of course, be understood that food 50 could be any type of food which would benefit from being mixed during cooking, and may include, but should not be limited to soups, stir-frys, casseroles, chili, sauces, gravies, vegetables, or the like. While the food cooks, steam will be released from the food and gather inside the drum. Additionally, pressure will build inside the drum according to the ideal gas law. That is, assuming all other variables (namely, the moles of gas and the volume of the container) remain constant, as temperature rises due to cooking, pressure will rise proportionally. However, ventilation tube 44 and ventilation holes 40 act to release pressure and steam, as illustrated by arrow 52.

The installation and removal process of apparatus 12 into and out of a microwave oven are shown in FIGS. 4A and 4B. Specifically, FIG. 4A shows that the end of support shaft 34 is flush against the back of bracket 36. This creates distance x between the end of shaft 22 and the deepest point of socket 30. It can be seen that distance x is such that when the support shaft is flush against the back of bracket 36, driving shaft 22 and bottom 28 of drum 24 do not overlap, and therefore, socket 30 and driving shaft 22 can be easily aligned. FIG. 4B shows that shaft 34 is no longer flush against the back of bracket 36, as can be seen represented again by distance x, because shaft 22 is fully engaged in socket 30. Thus, it should be understood that by arranging bracket 34, shaft 22, drum 24, and socket 30 substantially as shown, specifically accommodating distance x between the support shaft and the bracket, socket 30 can quickly and easily be aligned and engaged with shaft 22 for installing the apparatus into a microwave oven. After the shaft and socket have been engaged, the drum is held on the driving shaft primarily by gravity, and is additionally supported by support shaft 34 and bracket 36. Thus, it should be understood that the drum can be loaded or unloaded from a microwave in just a few seconds.

Figure 5:
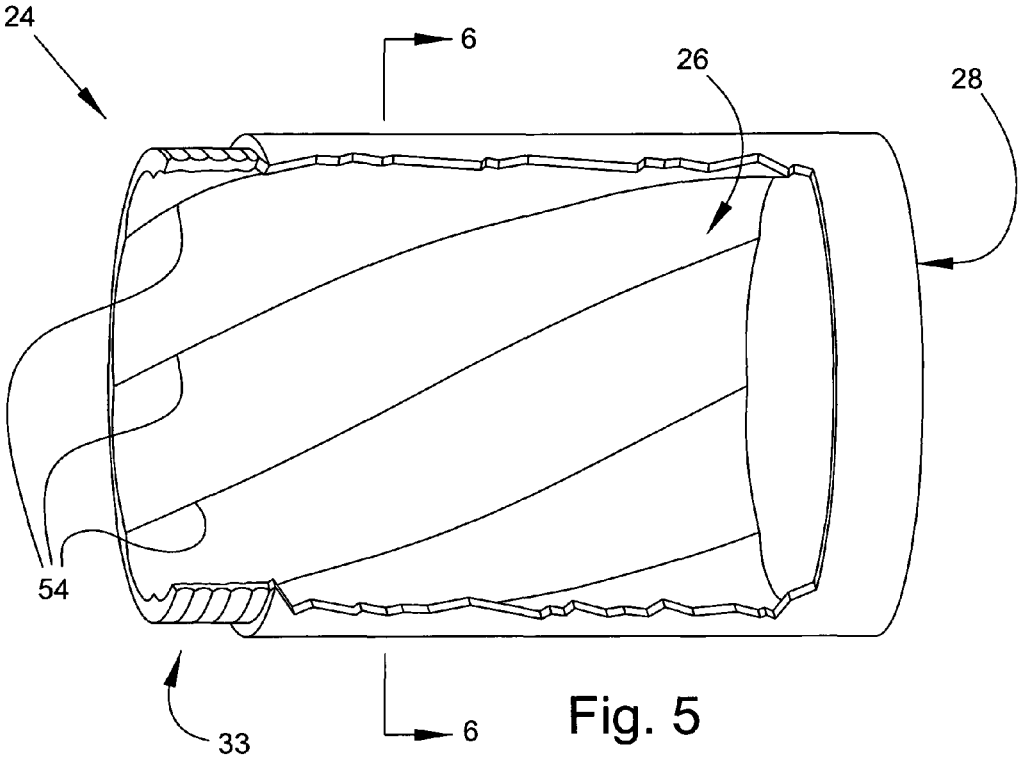
FIG. 5 is a perspective view of a drum for the current invention apparatus including a cutout showing mixing blades about an interior of the drum; and, FIG. 6 is a cross-sectional view of the drum taken generally along line 6-6 in FIG. 5.
Figure 6:
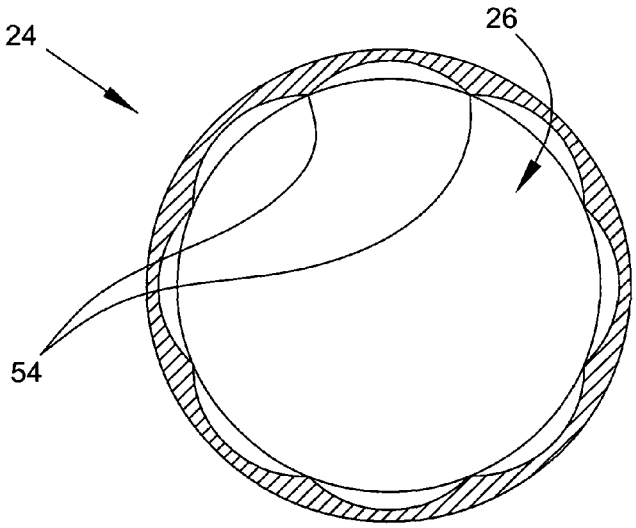

Drum 24 is shown generally as a hollow cylinder in FIGS. 1-4B. However, FIG. 5 shows a preferred embodiment of drum 24, particularly with respect to interior cavity 26 of drum 24. It can be seen that in the embodiment shown in FIG. 5, the interior walls of the drum include a mixing means, namely, blades 54. The blades, as shown, protrude into cavity 26 for mixing food. The blades are preferably twisted, or corkscrewed, about the interior wall of drum 24 that defines cavity 26. However, it should be appreciated that the blades could be longitudinally arranged along the interior of the drum in another embodiment. The corkscrew arrangement of the blades is particularly useful, as it can be used in conjunction with the rotation of the drum caused by motor 20 to pick up food from the bottom of the drum, and shift it closer to the top of the drum. Therefore, the food is not only mixing vertically due to rotation, but also shifting horizontally with respect to the drum. Consequently, food cooked using a drum of the arrangement shown in FIG. 5 will be very thoroughly mixed.

It should also be appreciated that the number or profile of the blades may vary in other embodiments, and only one illustrative example is shown. Also, the blades are shown having a "twist" of ninety degrees. That is, the blade starts at a first point and ends at a second point ninety degrees from the first with respect to a circumference of the drum. It should also be understood that blades in other embodiments may have more or less "twist." For instance, the blades may not corkscrew at all and run longitudinally down the drum, the blades could each corkscrew around half of the circumference, or a single blade could corkscrew around the entire interior circumference of the drum several times.

The current invention also provides several other advantages, particularly because the current invention cooking apparatus installs so quickly and easily into an oven, as shown in FIGS. 4A and 4B. For example, the current invention could be standardized to fit a variety of microwave ovens. Likewise, microwave ovens could be sold as compatible with the current invention cooking apparatus by including bracket 34, motor 20, and shaft 22. Even if a microwave included these components, but the microwave owner did not wish to use cooking apparatus 12, the user would still be able to use the oven in the conventional way, since these components do not interfere with the other operations of the microwave oven. Additionally, a second embodiment storage lid could be included that resembles a typical jar lid. That is, the storage lid would not include holes or a support shaft. In this way, the drum, in conjunction with the storage lid, could be used to store food, such as in a refrigerator, before or after cooking. Conveniently, when the stored food must be heated, a user would only need to exchange the storage lid with lid 32, and perhaps also include ventilation insert 42, and the drum would be immediately ready to be placed in a microwave for cooking. Furthermore, foods could be sold pre-made, such as in grocery stores, in sealed drums 24 that include storage lids, for example. Thus, a person could buy a pre-made meal contained within a current invention drum from a grocery store, where the meal is therefore immediately ready to be put in a microwave oven compatible with the current invention.

It should be appreciated that drum 24 is illustrated having a generally cylindrical shape, however, the drum could be virtually any other shape. For example, it could have a polygonal or oval shaped cross-section. Thus, it should be understood that the particular shape of the drum is not germane to the current invention, as long as the drum is capable of holding food and functioning in the manner as described above. Further, in the shown embodiments, shaft 22 and bracket 36 are shown at different heights, but at substantially the same depth into the cooking chamber. It should be appreciated that in another embodiment, the shaft could located in a back corner of the cooking chamber, angled (along an axis) toward a diagonally opposite front corner where the bracket is located. In such an embodiment, the driving shaft would impede even less on the conventional usage of the microwave oven, as the shaft would be located in a far back corner of the oven.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

I claim:

1. A rotary cooking apparatus for a microwave oven comprising:

a generally hollow drum for holding food, the drum comprising a first end, an integral closed second end and a longitudinal rotational axis, wherein the first end is open and the second end is closed;

a lid detachably securable onto the first end of the drum for sealing the drum, wherein the lid comprises a support shaft protruding from said lid axially aligned relative to the rotational axis and operatively arranged to engage in a freely rotatable manner with a support means, and wherein the lid further comprises a first ventilation hole for enabling steam and pressure to escape the drum during cooking;

a ventilation insert secured between the first end and the lid when the lid is secured onto the drum, wherein the ventilation insert comprises a ventilation means for enabling steam and pressure to escape the drum during cooking, and the first ventilation hole is misaligned relative to the ventilation means; and, a socket in the second end of the drum, wherein the socket has a shape corresponding to a cross-section of a head on a driving shaft of a motor, wherein the head of the driving shaft complimentarily engages the socket for rotating said drum via said motor.

2. The apparatus recited in claim 1 wherein said lid and said first end of said drum are complimentarily threaded for detachably securing said lid on said drum.

3. The apparatus recited in claim 1 wherein said drum includes a mixing means for thoroughly mixing said food during operation of said apparatus.

4. The apparatus recited in claim 3 wherein said mixing means comprises at least one blade arranged about an interior of said drum.

5. The apparatus recited in claim 4 wherein said at least one blade is corkscrewed about said interior of said drum.

6. The apparatus recited in claim 5 wherein said at least one blade is arranged with respect to an output direction of rotation of said motor to urge food in said drum located proximate to said second end of said drum towards said first end of said drum.

7. The apparatus recited in claim 1 wherein said drum is generally cylindrical.

8. The apparatus recited in claim 1 wherein said drum has a cross-sectional shape resembling a polygon or an oval.

9. The apparatus recited in claim 1 wherein the ventilation means in the ventilation insert comprises a second ventilation hole axially misaligned relative to the rotational axis, the support shaft comprises a longitudinal bore therethrough, the bore is axially aligned relative to the rotational axis, and the bore forms the first ventilation hole.

10. The apparatus recited in claim 1 wherein said driving shaft and said support shaft are concentrically aligned with respect to an axis.

11. The apparatus recited in claim 10 wherein said drum is generally aligned with respect to said axis.

12. The apparatus recited in claim 1 wherein the ventilation means in the ventilation insert is a ventilation tube axially aligned relative to the rotational axis, and the first ventilation hole is axially misaligned relative to the rotational axis.

13. A microwave oven comprising:

a cooking chamber having a first wall and an integral second wall, wherein said first and second walls are substantially opposite from each other;

a motor housed in said microwave oven, wherein said motor includes a driving shaft that extends through said first wall of said cooking chamber into said cooking chamber;

a support means proximate to said second wall of said cooking chamber; and, a rotary cooking apparatus housed within said cooking chamber of said microwave oven including:

a generally hollow drum for holding food, said drum including a first end and an integral closed second end, wherein said first end is open and said second end is closed;

a lid detachably securable onto said first end of said drum for sealing said drum, wherein said lid includes a support shaft protruding from said lid operatively arranged to engage in a freely rotatable manner with said support means, wherein said lid includes a ventilation hole for enabling steam and pressure to escape said drum during cooking;

a socket in said second end of said drum, wherein said socket has a shape corresponding to a cross-section of a head on said driving shaft of said motor, wherein said head of said driving shaft is operatively arranged to complimentarily engage in said socket for rotating said drum via said motor;

a ventilation insert secured between said cooking drum and said lid when said lid is secured onto said drum, wherein said ventilation insert includes a ventilation means for enabling an escape of steam and pressure from said drum during operation of said oven and, wherein said support shaft and said driving shaft are concentrically aligned with an axis, and said axis is arranged obliquely between said first wall and second wall of said cooking chamber, and wherein the ventilation insert comprises holes misaligned relative to a rotational axis and the support shaft comprises a longitudinal bore therethrough.

14. The microwave oven recited in claim 13 wherein said support means is a support bracket mounted on said second wall, and said support bracket includes a notch for engaging with said support shaft.

15. A drum for a rotary cooking apparatus comprising:

a cavity for holding food, generally defined by said drum;

a first end and an integral closed second end, wherein said first end is open and said second end is closed;

a lid detachably securable onto said first end of said drum for sealing said drum, wherein said lid includes a support shaft protruding from said lid;

a ventilation insert positioned between said lid and said first end, wherein said ventilation insert includes a ventilation means for enabling an escape of steam and pressure from said drum during operation; and, a socket in said integral closed second end of said drum, wherein said socket has a shape corresponding to a cross-section of a head on a driving shaft of a motor, wherein said head of said driving shaft is operatively arranged to complimentarily engage in said socket for rotating said drum via said motor, wherein the ventilation insert comprises holes misaligned relative to a rotational axis, and the support shaft comprises a longitudinal bore therethrough.

16. The drum recited in claim 15 further comprising at least one mixing blade arranged about an interior of said drum for mixing food in said cavity of said drum.

* * * * *